US006866691B1

(12) United States Patent
Bancon et al.

(10) Patent No.: US 6,866,691 B1
(45) Date of Patent: Mar. 15, 2005

(54) METHOD AND INSTALLATION FOR MAKING ABRASIVE GRINDERS AND GRINDER OBTAINED BY SAID METHOD

(75) Inventors: Georges Bancon, Chalon sur Saone (FR); Jean-Marie Albrecht, Amboise (FR); Jean-Jacques Bris, Bey (FR); Nicolas Faures, Chalon sur Saone (FR)

(73) Assignee: Saint-Gobain Abrasifs Technologie et Services, Conflans-Saint-Honorine (FR)

( * ) Notice: Subject to any disclaimer, the term of this patent is extended or adjusted under 35 U.S.C. 154(b) by 0 days.

(21) Appl. No.: 10/009,351

(22) PCT Filed: Jun. 9, 2000

(86) PCT No.: PCT/FR00/01602

§ 371 (c)(1),
(2), (4) Date: Jun. 7, 2002

(87) PCT Pub. No.: WO00/74898

PCT Pub. Date: Dec. 14, 2000

(30) Foreign Application Priority Data

Jun. 9, 1999 (FR) ..... 99 07282

(51) Int. Cl.[7] ..... B24D 18/00

(52) U.S. Cl. ..... 51/293; 51/295; 51/297; 51/298; 51/307; 51/308; 51/309

(58) Field of Search ..... 51/293, 295, 297, 51/298, 307, 308, 309; 451/533, 540, 544, 559; 428/109, 323, 327, 110

(56) References Cited

U.S. PATENT DOCUMENTS 2,284,738 A 6/1942 Hurst
2,355,667 A * 8/1944 Melton et al. ..... 451/534
2,393,267 A * 1/1946 Robie et al. ..... 51/297
2,457,012 A * 12/1948 Upper ..... 51/297
2,540,112 A * 2/1951 Goepfert et al. ..... 451/541
3,023,551 A * 3/1962 Osenberg ..... 451/544
3,121,981 A * 2/1964 Hurst ..... 451/544
3,576,090 A * 4/1971 Shoemaker ..... 451/548
3,653,858 A * 4/1972 Field ..... 451/510
3,950,148 A * 4/1976 Fukuda ..... 51/297
3,980,453 A * 9/1976 Fukuda ..... 51/297
4,226,602 A 10/1980 Fukuda
4,341,532 A * 7/1982 Oide ..... 51/297
4,615,151 A * 10/1986 Huber et al. ..... 51/293
5,092,082 A * 3/1992 Padberg et al. ..... 451/548
5,637,388 A 6/1997 White et al.

* cited by examiner

*Primary Examiner*—Michael A Marcheschi
(74) *Attorney, Agent, or Firm*—Oblon, Spivak, McClelland, Maier & Neustadt, P.C.

(57) ABSTRACT

An abrasive product is formed, in a blanket making machine, into a layer forming a blank including at least abrasive grains. The layer is then set atop on at least another material layer and assembled thereto. The installation includes, besides at least a blank making machine, an assembly line along which successive posts are provided at the site whereof the elements designed to form the grinder are set on top of one another to form a stack, a station for heating the stack, and at least a pressing machine to compress the heated stack. An embodiment need not include the heating station. The grinder is a thin grinder that can include at least a reinforcing layer pierced with a hole wherein the abrasive product is distributed. The process is useful for making grinders for parting, machining, or pumicing.

24 Claims, 4 Drawing Sheets

Figure 1:
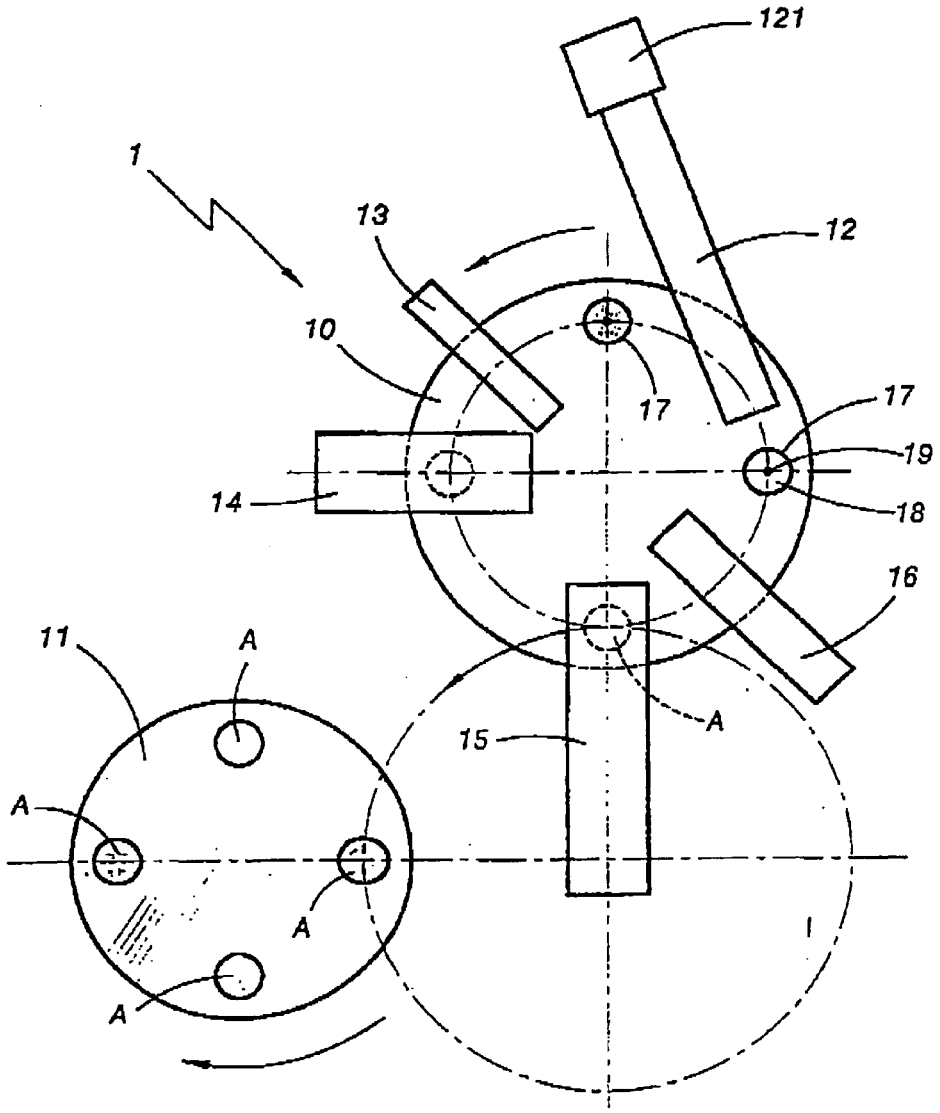

METHOD AND INSTALLATION FOR MAKING ABRASIVE GRINDERS AND GRINDER OBTAINED BY SAID METHOD

The invention relates to the production of abrasive grinding wheels, and more precisely to a process and installation for production of such grinding wheels, as well as to the grinding wheels obtained.

Abrasive grinding wheels of the so-called "thin grinding wheel" type (having a thickness of several millimeters), such as cutting-off grinding wheels, are generally produced at present by disposing, in a mold placed on a production plate, a central ring around which there are stacked layers of various materials designed to constitute the grinding wheel; for example, a so-called "paper" protective sheet is deposited on which a so-called "fabric" reinforcing sheet is superposed, which sheet is pierced with holes that can be defined by meshes if the sheet has a woven structure, a pulverulent product formed from abrasive grains provided with a coating constituted by a binder is poured onto the reinforcing sheet in such a way that this product becomes distributed in the holes of the reinforcing sheet and in addition constitutes a layer superposed on this reinforcing layer, the layer of pulverulent product is skimmed to reduce its thickness to the desired value, a second reinforcing sheet is superposed on the layer of pulverulent product, then, if the grinding wheel to be produced is of the type having a single layer of abrasive (so-called "monolayer" grinding wheel), a second so-called "paper" protective sheet is superposed on this reinforcing sheet, and the composite constituted in this way is compressed in a press, whereas a grinding wheel containing several layers of abrasives (so-called "multilayer" grinding wheel) is produced by alternately pouring a layer of pulverulent product and superposing a reinforcing sheet as many times as needed by the type of grinding wheel to be produced, before this second protective sheet is superposed and compression is applied.

Automatic operation of this process generally takes place on a carousel whose general shape is circular and whose sectors are equipped with working stations; each station is equipped with a plurality of identical tool assemblies for performing the same task simultaneously on the contents of a plurality of molds, the first task being laying of the ring and the second being discharge of the grinding wheels after pressing, this being performed on the table.

In relatively simple installations which are not designed to produce a very large number of grinding wheels, the carousel can be provided with, for example, six stations (for laying the ring, for laying the "paper", for laying the "fabric", for pouring the pulverulent product and skimming it by means of a sliding member, for laying the, second "fabric", for laying the second "paper", and for pressing and discharge) and with four tool assemblies per station, thus requiring the table already to have an area of several square meters; greater specialization of the stations quickly leads to eight-station installations, while the need to produce a larger quantity leads to stations that may each be provided with nine tool assemblies.

The tasks may be distributed over a plurality of carousels, between which the composites undergoing production must be transferred, all the more so if the number of pulverulent layers and therefore of tool assemblies with slides must be greater.

It is already obvious that, in the simple case of a carousel having six stations with four tool assemblies each, there must be disposed 24 tool assemblies, each of which has a very high cost.

In addition, the speed of rotation of the table is dictated by the duration of the longest task, which is generally pouring and skimming of the pulverulent product, or pressing if this is performed in a continuous sequence with the preceding tasks.

In addition, it is inevitable that some pulverulent product formed from abrasive grains will be accidentally spilled outside the mold, and even in very small quantity it leads to rapid wear of the carousel and of the tool assemblies associated therewith, especially the tool assemblies with slides, whose sliding becomes difficult; changing even of only a single tool assembly necessitates immobilization of the carousel and thus shutdown of production.

Likewise, it is necessary to change a large number of tool assemblies whenever it is desired to produce grinding wheels of a different type.

As a result, the real "availability" time of the carousel for the production of grinding wheels is relatively short.

In addition, the installation is not very flexible, because it is practically impossible to add stations or tool assemblies onto the carousel.

Furthermore, since pressing has to be performed simultaneously at high pressure on several composites, it is necessary to develop very large forces and thus to use materials and devices with high mechanical strength.

Finally, distribution of the pulverulent product on the surface of the "fabric" is difficult to control, and the grinding wheels are seen to exhibit more or less considerable unbalance that can cause disintegration of the grinding wheel while it is being used at high speeds of rotation.

The object of the invention is to remedy these disadvantages and, to this end, the invention relates to a process for production of grinding wheels of the thin grinding wheel type provided with an abrasive product, characterized in that it comprises a stage consisting of superposing at least two layers of constituent, one of which is a blank, which itself is constituted at least from abrasive grains, and of assembling these at least two layers of constituent.

By "layer of constituent" there is understood a layer provided with at least one material intended to constitute the grinding wheel. These materials are in particular of the so-called "paper" protective sheet type or of the so-called "fabric" reinforcing sheet type, or of the type of a layer formed from abrasive grains provided with a coating constituted by a binder.

By "blank" there is understood a layer of constituent having a consistency such that the blank can be manipulated, and in particular seized and moved by hand or by means of a machine.

According to one embodiment of the invention, at least one blank is constituted by adhesive grains coated with a binder.

According to another version of the invention, at least one blank comprises, in addition to abrasive grains coated with a binder, at least one layer of constituent without abrasive grains, especially a reinforcing layer, in particular constituted by glass fibers.

By virtue of the fact that a blank is made first of all and that the different layers are then superposed, the time for passage to each subsequent station can be appreciably shortened, since it no longer depends on the duration of the operations of pouring of the pulverulent product or of pressing under high pressure.

The process can also have one or more of the following characteristics:

to make the blank, an abrasive product formed from abrasive grains provided with a coating constituted by a binder is poured into a mold, the level of abrasive product is adjusted to a desired value, and the abrasive product is compressed;

the layers of constituent comprising at least one blank are laid successively one on top of the other to constitute a stack, then the stack is heated and subsequently the stack is pressed;

the layers of constituent are superposed along an assembly line, which is equipped with layer-laying stations and along which the layers being superposed are made to travel in the form of stacks, stocks of stacks being constituted in at least certain stations, from which the stocked stacks are taken one by one to superpose thereon a new layer of constituent, and the stack provided with its new layer being evacuated from the station toward the following station.

In another version according to the invention, when the blank comprises at least one layer of constituent without abrasive, an abrasive product formed from abrasive grains provided with a coating constituted by a binder is first poured into the mold, the level of abrasive product is adjusted to a desired value, at least one other layer of constituent without abrasive, especially a reinforcing sheet, is then laid above the level of the abrasive product, and the composite constituted by at least one reinforcing sheet and the abrasive product is compressed.

This last version is particularly suitable for obtaining so-called "extra-thin" grinding wheels, whose thickness is, for example, less than 2 mm, or even equal to or smaller than 1 mm. This particular type of grinding wheel is generally constituted by a "monolayer" grinding wheel, and it must be made with the greatest care to avoid the problems of unbalance or of lack of product in certain zones of the grinding wheel that are particularly acute when this type of grinding wheel is produced by traditional methods. In fact, it is often noted that the reinforcing layers are poorly distributed in the grinding wheel. The method according to the version of the invention where a blank provided with a reinforcing layer laid on a layer of abrasive is produced in a mold for making the said blank, makes it possible in particular to become free of the problems of unbalance and of lack of product in certain zones of the grinding wheel and thus to increase the yields of production of extra-thin grinding wheels considerably.

In fact, the action of first of all depositing the abrasive grains and then a reinforcing sheet and subsequently pressing the composite makes it possible to obtain a blank with plane and parallel faces in which the reinforcing sheet has been kept firmly in place against the upper face of the mold during the pressing operation. Stacking of at least one other layer of constituent on the said blank is performed with a plane reference surface, thus making it possible to obtain a grinding wheel in which the reinforcing sheets are distributed in plane and controlled manner in the grinding wheel once the composite has been pressed. It is then possible to make "extra-thin" grinding wheels with a thickness of 0.5 mm or even 0.4 mm, or even grinding wheels with the thickness of a single grain.

In addition, it is possible to automate, partly or fully, a grinding-wheel production line based on the principle of this process.

The invention also relates to an installation for making grinding wheels of the thin grinding wheel type provided with an abrasive product, characterized in that it is provided with at least one machine for making blanks from abrasive grains, an assembly line equipped in particular with stations disposed in succession, at the position of which layers intended to constitute the grinding wheel and comprising at least one blank obtained from the blank-making machine are superposed to constitute a stack of superposed layers, followed by a heating station where the stack of layers is heated, and at least one pressing machine for compressing the stack, this pressing machine having the form of a pressing station at the end of the assembly line or being positioned downstream from the assembly line.

By virtue of the fact that the installation is provided on the one hand with a blank-making machine and on the other hand with a heating station and a pressing station, the pressing operations can be performed at moderate pressure.

The installation can also have one or more of the following characteristics:

the blank-making machine is provided with a production carousel equipped with molds and specialized working stations comprising a station for pouring an abrasive, a leveling station, a pressing station, a discharge station and a cleaning station, and it is also provided with a storage table for storage of the produced blanks; for reasons of space requirements, it is possible to provide an installation in which the blank-making machine is provided with one or more stations, where two or more operations described hereinabove are combined in the same station. It will be preferable to choose a machine in which the abrasive-pouring and leveling stations are combined, especially for the production of extra-thin grinding wheels, the assembly line is provided with an endless conveyor which carries fixed plates configured to receive removable plates suitable for receiving stacks of elements constituting the grinding wheel, the assembly line is provided with a station for laying rings, stations for laying layers of constituent and a heating station, the assembly line is provided with a least one station comprising a temporary stocking device.

According to another advantageous version of the invention, the installation is provided with at least the following elements:

a station for filling a mold with the layer or layers of constituent from which a blank is formed, a machine for pressing the layer or layers of constituent contained in the mold in order to form the said blank, an assembly station designed to form a stack of superposed layers from at least one particularly suitable for the production of extra-thin grinding wheels.

The installation according to this latter version can also have one or more of the following characteristics:

the preceding elements are disposed around a production carousel on which at least one mold is fixed, the production carousel is divided into sectors corresponding to working stations for the consecutive operations, each sector comprises at least one position X for a mold and at least one position Y on which one or more layers of constituent of a grinding wheel can be disposed.

According to another advantageous version, the production carousel is divided into a plurality of sectors, each sector corresponding respectively to the working stations where the following consecutive operations are performed:

deposition and leveling of abrasive grains coated with a binder in a mold situated at a position X of the sector, especially by means of a tool, and deposition of at least one layer of component, especially a protective layer, at a position Y of the said sector, deposition of at least one layer of component, especially a reinforcing sheet, on the abrasive grains in the mold, and deposition of at least one layer of component, especially a protective sheet and/or a reinforcing sheet, at a position Y, pressing by means of the machine designed to form at least one pressed blank from the layers of constituent contained in at least one mold, constitution of the stack, which consists in taking at least one blank from a position X to lay it at a position Y and thus constituting at least one stack formed by the layers of constituent disposed beforehand in a location Y by at least and one blank, pressing of the stack situated at position Y in order to consolidate a grinding wheel by means of the pressing machine, evacuation of the grinding wheel or wheels.

In this configuration of the installation, the blank-making machine is integrated into the assembly line. It must be noted that it is also possible to construct an installation with the elements disposed in line.

Each of the installations described hereinabove can also have one or more of the following characteristics:

the pressing machine is provided with a carousel equipped with jack-operated presses provided with a movable tool assembly comprising a mold provided with a bottom and a side wall mounted slidingly around the bottom, and with a mold support, which is fixed to the piston of the jack and to which the bottom and the side wall are interlocked by spring devices, which are designed such that, during extension of the jack, they subject the stack to pressing force while surrounding it with the side wall and, during retraction of the jack, they initiate the start of upward movement of the side wall while the bottom is still against the stack, then the upward movement of the bottom while the side wall continues its upward movement, the pressing machine is provided with presses, each equipped with a support for a removable plate suitable for receiving a stack of layers of constituents of the grinding wheel, and with a cam surface over which there travel rollers, each interlocked with a support to raise the support for the purpose of evacuation of the grinding wheel and of reloading of the removable plate on the assembly line.

According to another version of the invention, the disposition of the pressing elements can be inverted, with the removable plate situated above the mold. In this version, the stack to be pressed on the mold bottom, the mold bottom and the mold then are actuated until the side walls of the mold come into contact with the lower face of the plate in order to close the mold, and allow the pressing operation to begin.

The invention also relates to a grinding wheel of the thin grinding wheel type provided with an abrasive product and made by the process defined hereinabove, characterized in that it comprises at least one reinforcing layer perforated with holes in which there is distributed a part of the abrasive product formed from abrasive grains.

The grinding wheel can also have one or more of the following characteristics:

it is provided with a central ring, it is provided with at least one layer of abrasive product, and each layer of abrasive product is sandwiched between two reinforcing layers, its thickness is less than or equal to 2 mm, or even less than or equal to 1 mm.

The invention also relates to a factory or factory section for production of grinding wheels, especially of the thin grinding wheel type, provided with an abrasive product, wherein the factory or the factory section is divided into at least two zones, one zone being designed for the production of blanks constituted at least from abrasive grains and grains from the zone of final production of the grinding wheels. This installation is particularly advantageous, because the abrasive grains cannot be dispersed in the zone of final production of the grinding wheels, thus making it possible to obtain clean rooms and also to prolong the useful life of the machines greatly by avoiding the abrasion or the malfunctions associated with abrasive grains, which are usually spread through the entire grinding-wheel production shop. It is possible in particular to achieve large economies, because air conditioning or precise temperature control of the final production zone is then unnecessary, since a blank has greater thermal stability than the abrasive grains coated by a binder.

Figure 2:
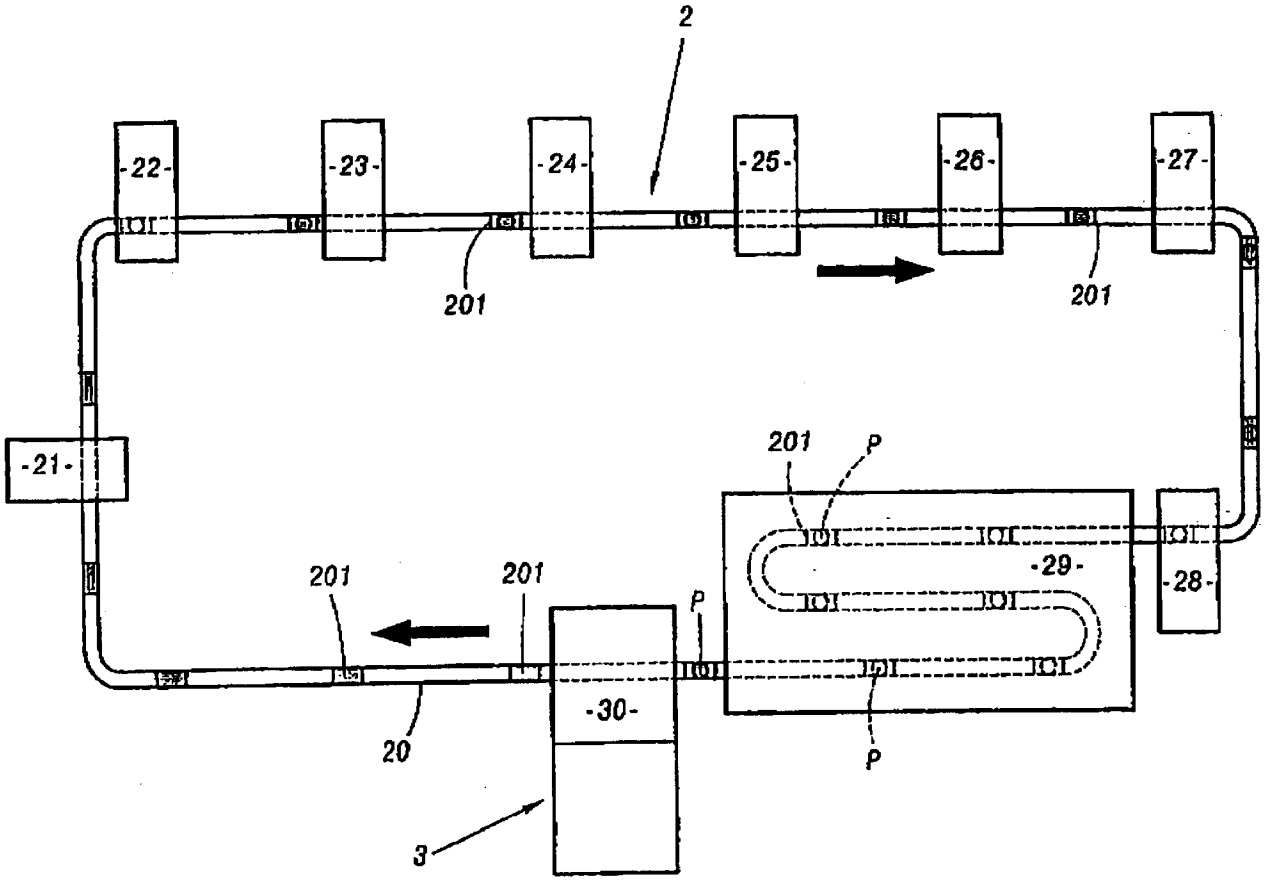
Figure 3:
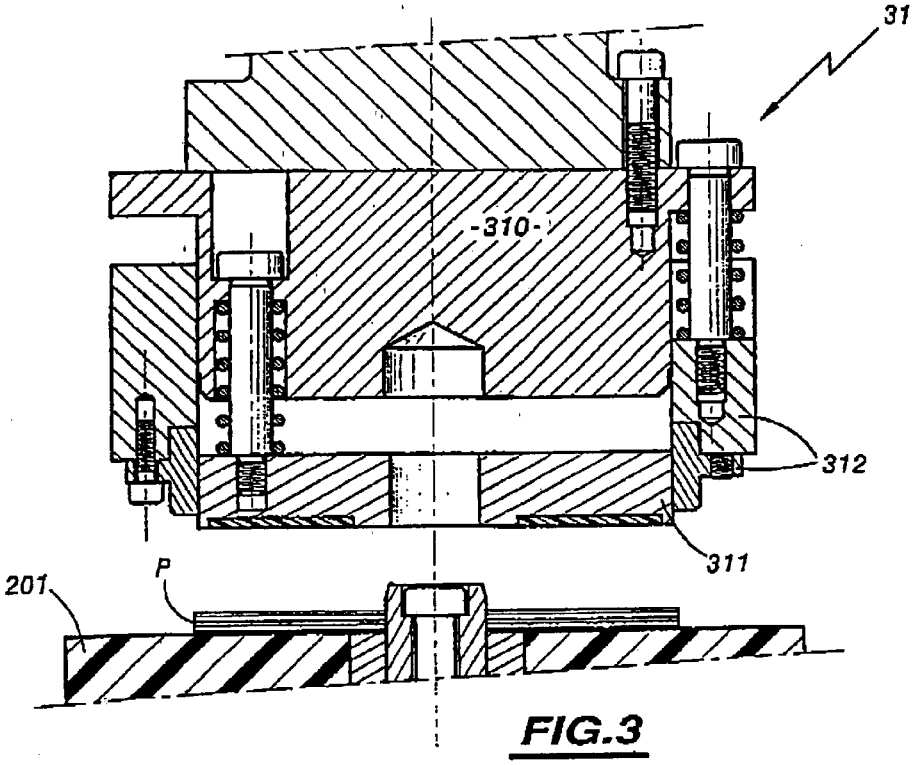
Figure 4:
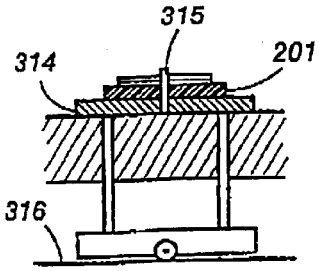
Figure 5:
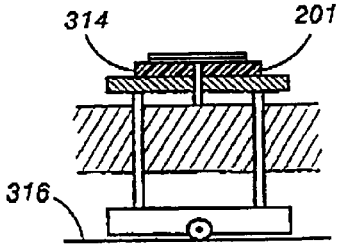
Figure 6:
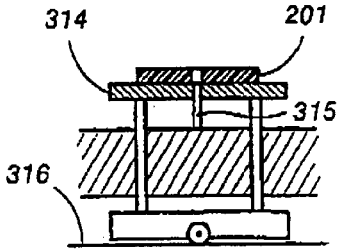
Figure 7:
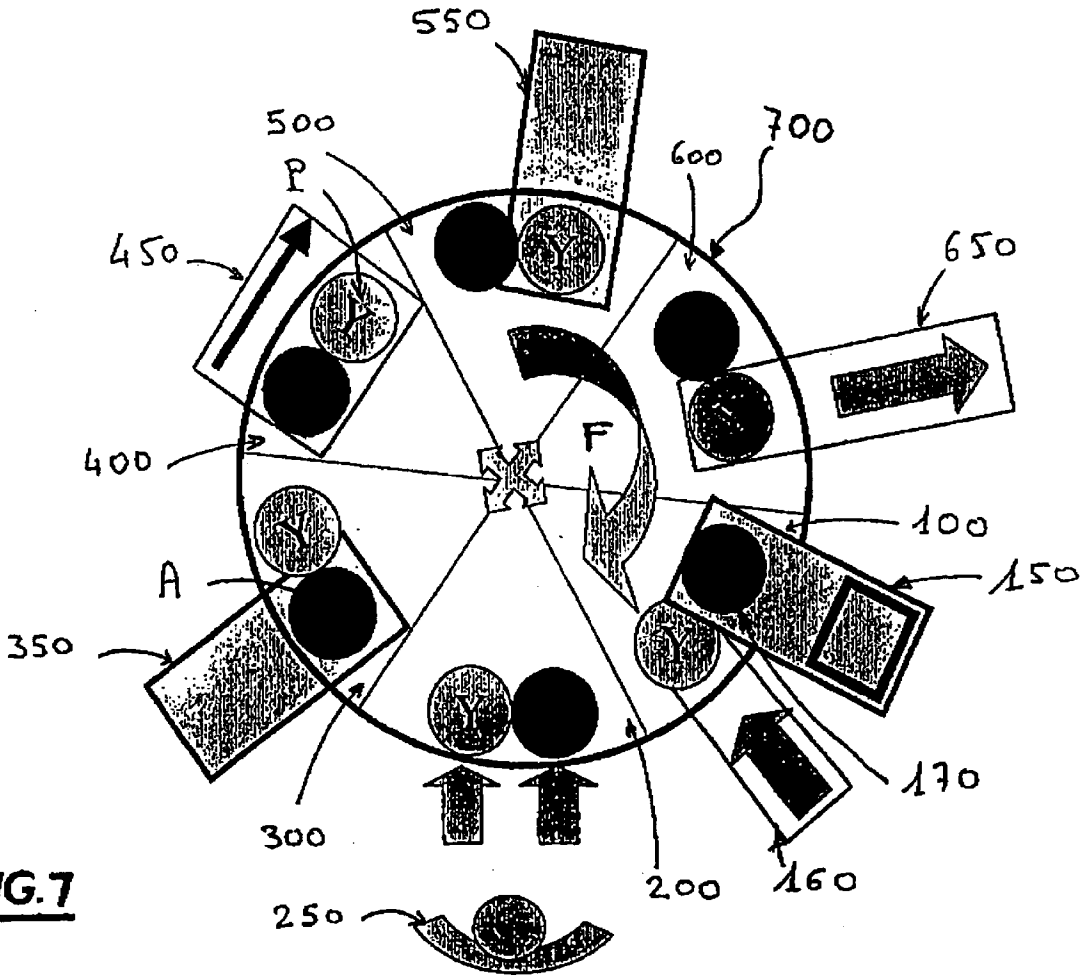

Other characteristics and advantages of the invention will become evident from the description hereinafter of a process and an installation according to this invention and of an obtained grinding wheel, given by way of non-limitative example and illustrated by the attached drawings, wherein:

FIG. 1 is a schematic top view of a blank-making machine suitable for use within the scope of the invention, FIG. 2 is a schematic top view of an assembly line with which there is associated a pressing machine for production of abrasive grinding wheels from blanks made by the machine of FIG. 1, FIG. 3 is a schematic section through a vertical plane of part of a press with which the pressing machine shown schematically in FIG. 2 is equipped, FIGS. 4 to 6 are schematic sections through a vertical plane of elements of the press, part of which is shown schematically in FIG. 3, for facilitating evacuation of the grinding wheels after pressing and reloading of the assembly line, and FIG. 7 is a schematic top view of an installation for production of abrasive grinding wheels which is suitable in particular for the version of the process according to the invention in which blank A comprises at least one layer of constituent without abrasive grains.

According to the invention, the production of an abrasive grinding wheel does not comprise the stage which consists of pouring a pulverulent abrasive product formed from abrasive grains onto a so-called "fabric" reinforcing layer, but instead comprises a stage which consists of making, from such abrasive grains provided with a coating constituted by a binder, an abrasive blank that can be used as a constituent layer in the production of the grinding wheel; to this end, it is possible, for example, to superpose this blank on a classical reinforcing layer, which itself is superposed on a so-called "paper" layer, and to cover it with a second reinforcing layer which in turn is covered by a "paper" layer to constitute a so-called "monolayer" grinding wheel (or in other words one with a single abrasive layer); for the purpose of constituting a multilayer grinding wheel, it is also possible to superpose on a reinforcing layer a blank and a new reinforcing layer as many times as is necessary to obtain the desired characteristics.

Blank-making machine 1 illustrated by the diagram of FIG. 1 is provided with a stepping production carousel 10 of general circular shape, which is provided here with four sectors equipped with molds, and with specialized fixed working stations for respectively performing the different production tasks or operations on the contents of the molds when these pass opposite them; thus a plurality of blanks can be undergoing production simultaneously on table 10. It is also provided with a storage carousel 11, on which the blanks made on table 10 are aligned and/or stacked before being taken for transfer to an assembly line.

The stations with which machine 1 is equipped are an abrasive-pouring station 12, a station 13 for leveling by skimming, a pressing station 14, a blank-discharge station 15 and a table-cleaning station 16.

The molds, which have general cylindrical shape, comprise a side wall 17, in the interior of which there is mounted a sliding bottom 18 designed to slide in vertical direction and equipped with a central core 19.

Abrasive-pouring station 12 is equipped at its upper part with a reservoir 121 of abrasive product constituted from abrasive grains provided with a coating constituted by a binder; at its lower part, the pouring station has a closable slit in order that the product can be poured into the mold when this is positioned under the slit, the mold bottom being positioned in the side wall at a depth greater than the thickness desired for the blank.

Since a slight excess of abrasive product is poured in, leveling station 13 skims the product flush with side wall 17 of the mold.

Pressing station 14 compresses the product by means of a force on the order of several metric tons (or tens of thousands of newtons), thus forming blank A, which is scheduled to be introduced into the assembly line, to be described hereinafter.

Discharge station 15 transfers blanks A from production table 10 to storage table 11.

Cleaning station 16 cleans the sector of table 10 that passes opposite it, downstream from the discharge station.

Thus, in the present case in which each of the four sectors of table 10 is equipped with a single mold, one mold is being filled, one mold is being skimmed, one blank is being pressed and one blank is being discharged from the production table, all simultaneously or quasi-simultaneously.

By virtue of the fact that blanks ready for introduction into an assembly line are being made, it is easier to produce grinding wheels of different dimensions and, for example, to switch from "monolayer" grinding wheels to "multilayer" grinding wheels or even to switch from production of 115 mm grinding wheels to production of 125 mm grinding wheels and vice versa.

In fact, since the tool assemblies of the stations are not very complex, they can be changed very quickly in the event of a production change or breakdown.

In addition, the carousel has relatively small dimensions (the diameter can be reduced to a value smaller than one meter), and the molds, which are used exclusively for making blanks, have light weight (less than 15 kg).

The pressing force to be exerted on the abrasive product to constitute the blanks one by one is relatively moderate, on the order of several metric tons (or tens, of thousands of newtons) for about 1 second.

As a result, an output of 1000 blanks per hour can be achieved easily with a four-mold carousel.

In addition, since the abrasive product is present in the assembly line only in the form of blanks and no longer in pulverulent form, the wear of the assembly line in which the layers of constituents are stacked is appreciably reduced.

Assembly line 2 illustrated by the diagram of FIG. 2 is designed for the production of grinding wheels with two abrasive layers, and therefore with two blanks in the present case.

It is provided with an endless conveyor 20, along which there are distributed specialized fixed working stations for respectively performing the different operations of production of the grinding wheel proper. This conveyor, carries plates which are fixed thereto and are configured to receive removable plates 201, on which the different elements, and in particular the different layers of constituents of the grinding wheels, are stacked one on top of the other as the conveyor rolls along.

More precisely, assembly line 2 is provided with, in succession, in the rolling direction of conveyor 20, a station 21 for laying the central ring, a station 22 for laying the base "paper", a station 23 for laying the lower reinforcing layer, a station 24 for laying the lower blank, a station 25 for laying the central reinforcing layer, a station 26 for laying the upper blank, a station 27 for laying the upper reinforcing layer, a station 28 for laying the upper "paper", a heating station 29 and a discharge and reloading station 30.

Each working station designed to superpose a layer of constituent has available a stock of stacks, each carried on a removable plate 201, and so a brief interruption of the operation of one of the stations, due to a breakdown, for example, does not completely interrupt production of the grinding wheels, since the working stations situated downstream work on their stock and the upstream working stations can be instructed to build up their stocks. In this way, therefore, desynchronization of the production operations is advantageously achieved here.

Heating station 29 heats the stacks P, which pass through it at a temperature of approximately 50 to 80° C., thus facilitating easy flow of the abrasive product constituting the blanks into the holes of the reinforcing layer, such as the meshes in the case of a true fabric or similar material.

Since each station performs a single superposition operation, the assembly line has a certain modularity and an increase in the number of layers can be achieved by simple addition of the appropriate number of stations; for example, to make grinding wheels containing three blanks, it is sufficient to add one station for laying blanks and one station for laying reinforcing layers to the assembly line just described.

In the case in which the reinforcing or "fabric" layers are delivered lined with the "paper" layer, the two immediately successive stations, respectively that for laying the "paper" and that for laying the "fabric" (or vice versa), are replaced by a single station.

It may be pointed out that the laying stations may be automated or manual.

Downstream from assembly line 2, the installation is provided with a pressing machine 3, in which the removable plates exiting heating station 29 together with their contents are transferred via discharge and reloading station 30; alternatively, this pressing machine could be made a part of the assembly line.

Pressing machine 3 is provided with a carousel of general circular shape provided with, for example, six sectors equipped with identical jack-operated presses moving successively to a plate-receiving position. As each removable plate arrives at discharge and reloading station 30 with its stack, it is transferred to the jack-operated press which for the moment is located at this position and which, while continuing its circular path, presses the hot stack present on the plate then interrupts the pressing action such that, at an evacuation position, the grinding wheel formed as a result of pressing of the stack is evacuated while still hot from the press via an evacuation station, and removable plate 201 is transferred via discharge and reloading station 30 back to conveyor 20. As a result of pressing, the different layers of constituents become coalesced, part of the abrasive product of each blank being distributed in the holes of the reinforcing layers and, after cooling, the grinding wheel assumes its final structure.

Since the abrasive product was already in the form of blanks, the duration of the pressing stage is relatively short and, since each press operates only on one stack, the pressing force can be kept at a relatively moderate value (on the order of 20 metric tons, or in other words about $2.10^5$ N).

Press 31, part of which is illustrated schematically in FIG. 3, is provided with a movable upper tool assembly comprising a pressing mold, which is designed to fit from above around stack P of layers of constituents placed on removable plate 201 during the pressing operation, and which is interlocked with a mold support 310 fixed at the end of the piston of the jack. This mold is provided with a bottom 311 and a side wall 312 mounted slidingly around the bottom, in order that the pressing force can be applied substantially to bottom 311 of the mold and thus deterioration of side wall 312 thereof can be avoided; preferably, lateral wall 312 is in two parts, in order to be able to change that of the two parts which is intended to be applied against the removable plate, in the event of deterioration. The mold bottom is interlocked with mold support 310 by at least one spring device which, in the absence of load, maintains the mold bottom at a distance from the mold support, and which, when the mold bottom is braced against the stack, becomes compressed to permit the mold support to be applied against the mold bottom and to transmit thereto the full pressing force; the mold side wall is interlocked in the same way with the mold support, the only difference being that the free end of the lateral wall is retracted (upward) by a few millimeters relative to that of the bottom, while the distance separating it from the mold support is approximately identical as long as neither the bottom nor the side wall is braced thereagainst, or in other words as long as the springs of their respective interlocking devices are not compressed.

Thus, during downward extension of the jack, mold bottom 311 is brought into contact with stack P while side wall 312 is not yet in contact with removable plate 201. As mold support 310 continues its travel, the springs become compressed, the distance between the mold support and the mold bottom begins to decrease and, after a closing movement of several millimeters, the mold side wall itself comes into contact with removable plate 201; since mold support 310 is still continuing its travel, it comes into contact with mold bottom 311, and the pressing force is then applied to stack P while the mold support is not yet in contact with side wall 312 which, being in contact itself with removable plate 201, prevents any lateral spreading of the layers of stack P. After the desired time interval, the jack is retracted upward and mold support 310 moves upward, thus causing mold side wall 312 to begin moving back upward while mold bottom 311 is still applied against stack P, after which it moves upward in turn while the side wall is continuing its upward movement.

Since most of the movable components are in the upper part of the press, the risks of deterioration due to abrasive grains that have been accidentally detached from the grinding wheel are reduced.

With view to facilitating evacuation of the grinding wheels from the pressing machine and of reloading the assembly line with removable plates 201, which are threaded onto a spindle 315 carried by the table of the pressing machine and which extend across support 314, the pressing machine is provided at its lower part with a cam surface 316 on which there travels a roller interlocked by a strut structure with support 314 of removable plate 201 (FIGS. 4 to 6). Cam surface 316 has three levels. The lowest level of the cam surface corresponds to the pressing stage. When the roller reaches the intermediate level, support 314 becomes detached from the table of the pressing machine and, since the grinding wheel is at a level higher than the free end of spindle 315, it can be pushed sideways toward an evacuation conveyor; when the roller, in continuing its path over cam surface 316, reaches the highest level thereof, support 314 is separated even more from the table, and removable plate 201 itself reaches a level higher than the free end of spindle 315 and thus can be transferred once again onto the assembly line for the purpose of receiving a new ring and a new stack of layers of constituents.

The grinding wheels discharged from pressing machine 31 are then transferred in known manner into another heating station, where they are subjected to hot curing before being stocked for the purpose of delivery.

This installation permits riot only the production of flat grinding wheels as in the example described hereinabove but also the production of grinding wheels with offset hub.

Some or all of the transfer operations, especially between blank-making machine 1 and assembly line 2, in the stations of the assembly line or between the assembly line and pressing machine 3, may be manual.

It also results from the design of the installation just described that its reliability is greatly superior to that of the known installations; in addition, the space requirement of the installation is relatively small and, for the production of about one thousand grinding wheels per hour, for example, the footprint of the installation remains smaller than one hundred square meters.

By virtue of the modularity of the installation, it is possible to change the type of grinding wheel in about fifty minutes and the grinding-wheel diameter in about thirty minutes.

Similarly, it is possible to associate a plurality of blank-making machines with the assembly line in such a way that possible faults can be remedied quickly, or to provide blanks at two or more blank-laying stations in the case of production of multilayer grinding wheels or to prepare for the production, which can be linked together very quickly, of a second type of grinding wheel.

The production line illustrated in the diagram of FIG. 7 is designed for the production of monolayer grinding wheels from a blank A comprising one reinforcing layer.

It is provided with a production carousel 700, which turns in the direction of arrow F and is divided into a plurality of sectors 100, 200, 300, 400, 500, 600, each sector comprising a position X and a position Y, corresponding to a working station where the following operations are performed consecutively in the direction or rotation of arrow F and can take place simultaneously in time:

- sector 100 comprises a machine 150 for depositing and leveling abrasive grains coated with a binder to fill a mold 170 situated at a position X, and a means 160 for grasping and depositing a protective layer in order to deposit the said layer at a position Y,
- sector 200 comprises a means for grasping and depositing a reinforcing sheet above the abrasive grains in mold 170 situated at a position X and another reinforcing layer on the protective layer deposited beforehand at a position Y. On the figure, this operation is handled, for example, by an operator 250,
- sector 300 comprises a pressing machine 350 designed to compress the layers of constituent contained in mold 170 in order to form a blank A,
- sector 400 comprises means 450 for seizing blank A from position X and superposing it on the layers of constituent disposed beforehand at position Y in order to constitute a stack P, sector 500 comprises a pressing machine 550 for compressing stack P situated at position Y and thus forming a grinding wheel, sector 600 comprises means 650 for evacuation of the grinding wheel.

It must be noted that a press 31 of the type of that described in FIG. 3 can be used and can correspond to pressing machine 550 of sector 500.

It is also possible advantageously to use a press of this type with plate 0.201 situated above mold 31 and to deposit stack P on mold bottom 311, after which mold rim 312 is brought into contact with plate 201 and pressing can be performed.

It is possible to dispose a plurality of positions of type X and Y in each segment, in order to increase the number of grinding wheels produced at the same time on carousel 700. In particular, it is possible to use removable "cassettes", on which there are located one or more positions X and/or Y and which are disposed on carousel 700.

This system makes it possible quickly to change all positions X and Y of one sector or of all sectors of carousel 700, for the purpose of, for example, changing the dimension of positions X and Y in order to produce grinding wheels of a different size.

The production line may be manual, semiautomatic or fully automated.

The constancy of characteristics of the produced grinding wheels is remarkable in terms of regularity of thickness and unbalance.

What is claimed is:

1. A process for production of a grinding wheel having a central ring, the process comprising:

providing the central ring;

disposing a blank around the ring;

disposing a layer of a constituent superimposed on said blank; and compressing the blank and the layer of constituent, wherein said layer of constituent comprises a protective sheet, a reinforcing sheet or a combination thereof and said blank is formed by a method comprising:

pouring abrasive grains and a binder directly into a mold; and compressing the abrasive grains and the binder, wherein said blank is configured to be manipulated, seized, or moved by hand or by means of a machine.

2. The process according to claim 1, wherein the blank comprises at least one layer of constituent without abrasive grains, especially a reinforcing sheet.

3. The process according to claim 1, wherein pouring the abrasive grains comprises pouring the abrasive grains coated with the binder and compressing the abrasive grains comprises compressing the abrasive grains coated with the binder.

4. The process according to claim 1, wherein said compressing is accomplished without the application of heat.

5. The process according to claim 1, further comprising:

successively laying layers of constituent including the at least one blank one on top of the other to form a stack;

heating the stack; and thereafter compressing the stack.

6. The process according to claim 1, further comprising:

arranging layers in the form of stacks along an assembly line equipped with layer-laying stations;

providing stocks of stacks at at least certain stations, from which the stocked stacks are taken one by one to superpose thereon a new layer of constituent;

and evacuating the stack provided with its new layer from one station toward the following station.

7. An installation for making a grinding wheel having a central ring, comprising:

at least one machine for making blanks from abrasive grains;

an assembly line equipped with stations disposed in succession for providing the central ring and superposing at least one blank obtained from the blank-making machine and at least another constituent layer to constitute a stack of superposed layers; and at least one pressing machine for compressing the stack, the at least one pressing machine having a form of a pressing station positioned at one of an end of the assembly line or downstream from the assembly line, wherein said blanks are formed by pouring abrasive grains and a binder directly into a mold and compressing the abrasive grains and the binder, and said blanks are configured to be manipulated, seized, or moved by hand or by means of a machine.

8. The installation according to claim 7, wherein the blank-making machine is provided with a production carousel equipped with molds and specialized working stations comprising a station for pouring the abrasive grains and binder, a leveling station, a pressing station, a discharge station, a cleaning station, and a storage table for storage of produced blanks.

9. The installation according to claim 7, wherein the assembly line comprises an endless conveyor that carries fixed plates configured to receive removable plates, each removable plate configured to receive one of the stacks of superposed layers.

10. The installation according to claim 7, wherein the assembly line is provided with a station for laying rings followed by several stations for laying layers of constituent and the heating station.

11. The installation according to claim 7, wherein the assembly line is provided with a at least one station comprising a temporary stocking device.

12. An installation for production of a grinding wheel having a central ring, comprising:

a station for filling a mold with abrasive grains and a binder from which at least one blank is formed;

a machine for pressing the abrasive grains and the binder contained in the mold in order to form the blank;

an assembly station designed to form a stack of superposed layers from at least one blank and at least one other layer of constituent and to provide the central rind to the stack of superposed layers;

a pressing machine for compressing the stack and forming the grinding wheel.

13. The installation according to claim 12, wherein the stations and machines are disposed around a production carousel on which at least one mold is fixed.

14. The installation according to claim 13, wherein the production carousel comprises sectors corresponding to working stations for consecutive operations, and each sector comprises at least a first position for a mold and at least a second position on which one or more layers of constituent of the grinding wheel are configured to be disposed.

15. The installation according to claim 14, wherein the following consecutive operations are performed:

deposition and leveling of abrasive grains coated with a binder in a mold situated at a first position of a sector, especially by means of a tool, and deposition of at least one layer of component, especially a protective layer, at a second position of the sector;

deposition of at least one layer of component, especially a reinforcing sheet, on the abrasive grains in the mold at the first position, and deposition of at least one layer of component, especially a protective sheet and/or a reinforcing sheet, at the second position;

pressing by the pressing machine designed to form at least one blank from the layers of constituent contained in the at least one mold;

forming a stack, which takes at least one blank from the first position to lay it at the second position and thus constituting at least one stack formed by the layers of constituent disposed beforehand in a location and by the at least one blank;

pressing the stack situated at the location in order to consolidate a grinding wheel by the pressing machine; and evacuation of the grinding wheel.

16. The installation according to claim 7, wherein the pressing machine comprises a carousel equipped with jack-operated presses provided with a movable tool assembly, the jack-operated presses comprising a mold provided with a bottom and a side wall, the side wall mounted slidingly around the bottom, the jack-operated presses further comprising a mold support fixed to a piston of the jack, interlocked by a first spring device to the bottom, and interlocked by a second spring device to the side wall, whereby during extension of the jack, the bottom under the influence of the first spring device and mold support subjects the stack to a pressing force while the side wall under the influence of the second spring device and the mold support surrounds the stack and, during retraction of the jack, an upward movement of the side wall is initiated while the bottom is still against the stack and then the upward movement of the bottom occurs while the side wall continues its upward movement.

17. The installation according to claim 7, wherein the pressing machine is provided with presses, each equipped with a support for a removable plate configured to receive a stack of layers of constituents of the grinding wheel, and with a cam surface over which rollers travel, each roller interlocked with a support to raise the support for evacuation of the grinding wheel and reloading of the removable plate on the assembly line.

18. A factory or factory section for production of a grinding wheel having a central ring, wherein the factory or the factory section is divided into at least first and second zones, and the first zone is configured for production of blanks constituted from abrasive grains and a binder and the second zone is configured for assembly of at least one blank, the central ring, and at least one other layer of constituent without abrasive grains in order to form a grinding wheel by application of pressure.

19. The installation of claim 7, wherein said pressing machine compresses the stack without an application of heat.

20. The installation of claim 12, wherein said pressing machine compresses the stack without applying heat.

21. The factory of claim 18, wherein said application of pressure is performed without applying heat.

22. The installation of claim 7, wherein the blanks are formed by pouring the abrasive grains coated with the binder directly into the mold and compressing the abrasive grains coated with the binder.

23. The installation of claim 12, wherein the station is configured to fill the mold with the abrasive grains coated with the binder and the machine for pressing is configured to press the abrasive grains coated with the binder.

24. The factory of claim 18, wherein the first zone is configured to produce the blanks from the abrasive grains coated with the binder.

* * * * *

UNITED STATES PATENT AND TRADEMARK OFFICE

CERTIFICATE OF CORRECTION

PATENT NO. : 6,866,691 B1
DATED : March 15, 2005
INVENTOR(S) : Bancon et al.

It is certified that error appears in the above-identified patent and that said Letters Patent is hereby corrected as shown below:

Title page,
Items [45] and [*] Notice, should read
-- [45] **Date of Patent: *Mar. 15, 2005**

[*] Notice: Subject to any disclaimer, the term of this patent is extended or adjusted under 35 U.S.C. 154(b) by 0 days.

This Patent is subject to a terminal disclaimer. --

Signed and Sealed this

Twenty-fourth Day of May, 2005

JON W. DUDAS
*Director of the United States Patent and Trademark Office*